US008012275B2

(12) United States Patent
Kawano et al.

(10) Patent No.: US 8,012,275 B2
(45) Date of Patent: Sep. 6, 2011

(54) METHOD FOR MANUFACTURING MATERIAL FOR FORMING COMPOSITE METAL AND METHOD FOR MANUFACTURING ARTICLE FORMED FROM COMPOSITE METAL

(75) Inventors: Taku Kawano, Nagano (JP); Tomoyuki Sato, Nagano (JP); Atsushi Kato, Nagano (JP); Masashi Suganuma, Nagano (JP); Keita Arai, Nagano (JP); Daisuke Shiba, Nagano (JP)

(73) Assignee: Nissei Plastic Industrial Co., Ltd (JP)

( * ) Notice: Subject to any disclaimer, the term of this patent is extended or adjusted under 35 U.S.C. 154(b) by 388 days.

(21) Appl. No.: 12/284,105

(22) Filed: Sep. 18, 2008

(65) Prior Publication Data

US 2010/0064851 A1 Mar. 18, 2010

(51) Int. Cl.
*C22C 1/05* (2006.01)

(52) U.S. Cl. ..... 148/538; 148/549; 148/557

(58) Field of Classification Search ..... 148/538, 148/549

See application file for complete search history.

(56) References Cited

U.S. PATENT DOCUMENTS

| | | | | |
|---|---|---|---|---|
| 5,183,632 | A * | 2/1993 | Kiuchi et al. | 419/48 |
| 6,592,687 | B1 * | 7/2003 | Lee et al. | 148/418 |
| 6,860,314 | B1 * | 3/2005 | Koide et al. | 164/113 |
| 6,874,563 | B2 * | 4/2005 | Koide et al. | 164/97 |
| 2002/0148325 | A1 * | 10/2002 | Bergsma | 74/593 |

FOREIGN PATENT DOCUMENTS

EP 1016477 A2 * 7/2000

* cited by examiner

*Primary Examiner* — George Wyszomierski
(74) *Attorney, Agent, or Firm* — Adams & Wilks

(57) ABSTRACT

In a method for manufacturing a composite-metal-forming material, heating a metal material a Mg alloy or an Al alloy is heated to a temperature in a region where a solid and a liquid are both present to thereby yield a semi-molten metal material in a semi-molten state. An additive material is introduced to the semi-molten metal material and kneading is performed to obtain a composite metal material. The composite metal material is heated to a solution temperature of the metal material and a solution treatment is performed to thereby yield a composite-metal-forming material. The additive material introduced is a carbon nano-composite material formed by mixing a carbon nanomaterial and a metal powder to obtain a carbon nano-composite metal powder, compacting the carbon nano-composite metal powder into a solid to obtain a preform, heating the preform in a vacuum, inert gas, or non-oxidizing gas atmosphere to a temperature in a region where a solid and a liquid are both present, and applying pressure to the heated preform.

18 Claims, 10 Drawing Sheets

FIG.4
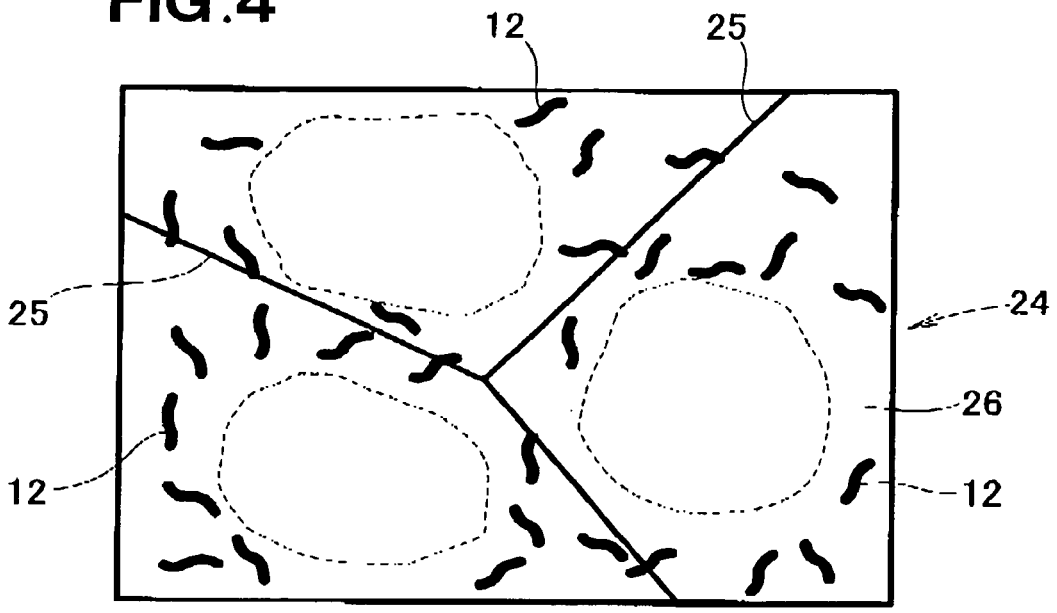
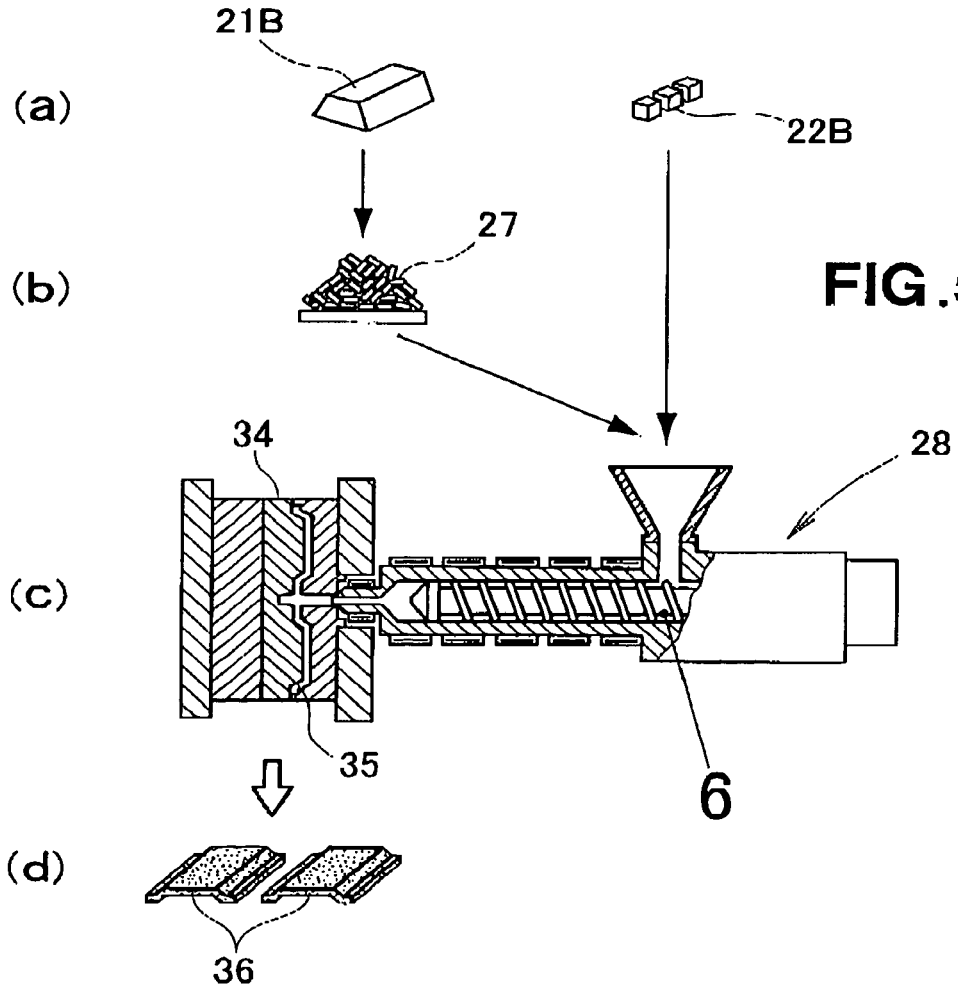
FIG.5

(a)
44
(b)
48
44
47
46
(c)
M
48
44
47
46
M
(d)
49

METHOD FOR MANUFACTURING MATERIAL FOR FORMING COMPOSITE METAL AND METHOD FOR MANUFACTURING ARTICLE FORMED FROM COMPOSITE METAL

FIELD OF THE INVENTION

The present invention relates to a technique for manufacturing a composite-metal-forming material obtained by kneading an additive material with a metallic material, and a technique for manufacturing a composite-metal-formed article.

BACKGROUND OF THE INVENTION

A metal material with a low melting point is cooled to a temperature at which a solid and liquid are both present, and in this state a carbon nanomaterial is kneaded with the low-melting metal material, to yield a composite material. A method for using a metal forming machine provided with heating means to inject and fill a die with the composite material and obtain a composite metal product is known, as disclosed in Japanese Patent Application Laid-Open Publication No. 2004-136363 (JP 2004-136363 A).

According to the composite forming method disclosed in JP 2004-136363 A, a molten low-melting metal material is cooled to a semi-molten state having a thixotropic property in which a liquid phase and a solid phase are both present. The low-melting metal material is kneaded in this state with a carbon nanomaterial, and a composite material is obtained. A metal forming machine provided with heating means is used to inject the composite material into a die while the thixotropic property is maintained; and a composite metal product is formed using the die.

Specifically, the method stated above is characterized in that the carbon nanomaterial is kneaded with the low-melting metal material in a semi molten state. Since the metal material is in a semi-molten state, the movement of the added carbon nanomaterial is limited, and the carbon nanomaterial can be prevented from rising or settling. As a result, a composite material of good quality can be obtained.

Of the liquid-phase portion and solid-phase portion that constitute the low-melting metal material in a semi-molten state, it is in the solid-phase portion that the carbon nanomaterial cannot be present. Therefore, the carbon nanomaterial composited by the method stated above is present in the liquid-phase portion.

If the added amount of the carbon nanomaterial is increased in order to improve functionality, the viscosity of the liquid-phase portion will increase, and the fluidity of the low-melting metal material in a semi-molten state will accordingly decline. A low-melting metal material in a semi-molten state of such description is harder to inject with a metal forming machine, and is not readily spread to all regions of the cavity of the die.

The technique mentioned above can be used when there is a small amount of carbon nanomaterial to be added, but cannot be used when the added amount is suitable.

SUMMARY OF THE INVENTION

An object of the present invention is to provide a composite-metal-forming material that can be used even in a case where the added amount of a carbon nanomaterial is sufficient.

According to a first aspect of the present invention, there is provided method for manufacturing a composite-metal-forming material, comprising: a step for preparing a metal material having a Mg alloy and an Al alloy, and a additive material for being added to the metal material; a step for heating the metal material to a temperature of a region where a solid and a liquid are both present, thereby yielding a semi-molten metal material in a semi-molten state; a step for introducing the additive material to the semi-molten metal material, performing kneading, and obtaining a composite metal material; and a step for heating the composite metal material to a solution temperature of the metal material, and performing a solution treatment, thereby yielding a composite-metal-forming material.

According to the present invention, a solution treatment is additionally performed on the composite metal material manufactured by the step for turning the metal material into a semi-molten state and the step for adding and kneading the additive material. The composite metal material that has been subjected to the semi-solidifying step and the kneading step is composed of a solid phase and a liquid phase. When the solution treatment is performed, the composite metal material assumes a solid solution structure in its entirety.

Since the composite-metal-forming material is in its entirety a solid solution structure, a part of the portion that was the liquid-phase prior to the solution treatment (erstwhile liquid-phase portion) will remain as a new solid-phase portion (new solid-phase portion) when the composite-metal-forming material is heated to a semi-molten temperature at a later step. Specifically, just as some of the erstwhile liquid-phase portion becomes the new solid-phase portion, and some of the erstwhile solid-phase portion becomes the new liquid-phase portion, heating the material after the solution treatment until the semi-molten temperature is reached causes a phase exchange to occur, albeit only partially. The additive material will be entrained in the new solid-phase portion.

However, the amount of the additive material in the new liquid-phase portion will decrease. As a result, the fluidity of the new liquid-phase portion will be improved.

As long as injection forming is performed in a semi-molten state, the additive material will uniformly spread, all regions of the cavity will be filled, and a product of good quality can be obtained.

The additive material is preferably a carbon nanocomposite material. Adding the carbon nanomaterial to the metal material makes it possible to provide a product having exceptional strength and heat conductivity. Since the material is mainly in a semi-molten state, it is possible to provide a formed product in which the carbon nanomaterial is uniformly dispersed, with no risk of the carbon nanomaterial aggregating.

The additive material is preferably a carbon nano-composite material formed by a step for mixing a carbon nanomaterial and a metal powder, and obtaining a carbon nano-composite metal powder; a step for compacting the carbon nano-composite metal powder into a solid, and obtaining a preform; a step for heating the preform in a vacuum, inert gas, or non-oxidizing gas atmosphere to a temperature of a region where a solid and a liquid are both present; and a step for applying pressure to the heated preform.

When the step for mixing the carbon nanomaterial with a metal powder and obtaining the carbon nano-composite metal powder is performed, the carbon nanomaterial deaggregates and is able to cover the metal powder; therefore, re-aggregation of the carbon nanomaterial can be prevented.

A step is subsequently performed whereby the preform formed by compacting the carbon nano-composite metal powder into a solid is heated to the temperature at which a solid and liquid are both present, and pressurized in that state; however, the powder is deaggregated in the mixing step, and the carbon nanomaterial covering is compression-deformed at the temperature where a solid and liquid are both present. It is accordingly possible to obtain a compression-formed article in which, the carbon nanomaterial has been adequately dispersed.

A shear force is applied at the same time that the preform is subjected to pressure in the step in which pressure is applied the preform. Applying the shear force at the same time that pressure is applied to the preform makes it possible to effectively destroy an oxide film that surrounds the powder surface. As long as the oxide film is able to be destroyed, the powder grains become closely attached, and the mechanical strength of the compression-formed preform can be increased.

Preferably, the metal powder comprises one selected from the group consisting of Mg, an Mg alloy, Al and an Al alloy. The Mg, Mg alloy, Al, and Al alloy are light metals, and adding the carbon nanomaterial to these metals and increasing the mechanical strength, makes it possible to provide a lightweight yet strong structural material having exceptional heat conductivity and abrasion resistance.

The carbon nanomaterial is preferably a metal-deposited carbon nanomaterial formed by causing a carbide forming element containing an element that reacts with carbon and forms a compound to adhere to a surface. The carbon nanomaterial has poor wettability, however, the carbide forming element has good wettability. Using a metal-deposited carbon nanomaterial having a carbide-forming element adhering to the surface makes it possible to improve the wettability of the carbon nanomaterial.

The metal-deposited carbon nanomaterial is preferably obtained by mixing the carbon nanomaterial with the carbide-forming metal, placing the resulting mixture into a vacuum furnace, and causing the carbide-forming metal to evaporate at a high, temperature in a vacuum. The carbide-forming metal forms a compound with the carbon, and the compound exhibits a bonding effect; therefore, the carbide-forming metal can be securely bonded to the carbon nanomaterial.

The carbide-forming metal is preferably Ti or Si. Ti and Si are both metals having melting points allowing vapor deposition to be performed in a vacuum, and have satisfactory wettability with regard to molten matrix metals. Si and Ti are both readily available, and Si in particular is inexpensive; therefore, both enable the method of the present invention to be used more widely, and are preferred.

There is preferably further included a step for crushing the composite-metal-forming material following the step for obtaining a composite-metal-forming material, whereby chips are obtained.

The composite-metal-forming material is crushed into chips composed of small aggregated masses, but the crushing also work-hardens the material, and the crystal grains hold internal strain (internal stress). Recrystallization occurs when the chips axe heated to the semi-molten temperature. The crystals that have deformed from the working are broken into fine polygonal grains as a result of the recrystallization, and reappear in a new structure comprising a new liquid-phase portion, a new solid-phase portion, and a new grain boundary. As a result, it is possible to obtain a composite metal material wherein the additive material is more reliably entrained in the new solid-phase portion. Since the aggregated masses are small, the transition to a semi-molten state can be performed in a short period of time.

According to another aspect of the present invention, there is provided a method for manufacturing a composite-metal-formed article comprising: a step for supplying to a metal injection machine a composite-metal-forming material manufactured by a method having a step for preparing a metal material comprising a Mg alloy or an Al alloy, and an additive for being added to the metal material; a step for heating the metal material to a temperature of a region where a solid and a liquid are both present, thereby yielding a semi-molten metal material in a semi-molten state; a step for introducing the additive material to the semi-molten metal material, performing kneading, and obtaining a composite metal material; and a step for heating the composite metal material to a solution temperature of the metal material, and performing a solution treatment, thereby yielding a composite-metal-forming material; and a step for using the metal injection machine to heat [the composite-metal-forming material] to a semi-molten temperature, subsequently supply [the composite-metal-forming material] to a cavity of a die, and obtain a composite-metal-formed article.

Since a material having exceptional fluidity is supplied to the cavity, the material will reach all regions of the cavity, and a composite-metal-formed article of high quality can be obtained.

BRIEF DESCRIPTION OF THE DRAWINGS

Certain preferred embodiments of the present invention will be described in detail below, by way of example only, with reference to the accompanying drawings, in which:

(*a*) through (*f*) of FIG. 1 are schematic views showing an embodiment of steps for manufacturing a composite-metal-forming material according to the present invention;

FIG. 4 is an enlarged view of part 4 of FIG. 1(*f*) and shows an image of the composition of the composite-metal-forming material;

FIG. 5(*a*) through (*d*) are schematic views showing steps for obtaining a composite-metal-formed article via a chipping step and an injection step using the composite-metal-forming material produced in FIG. 1;

Figure 7:
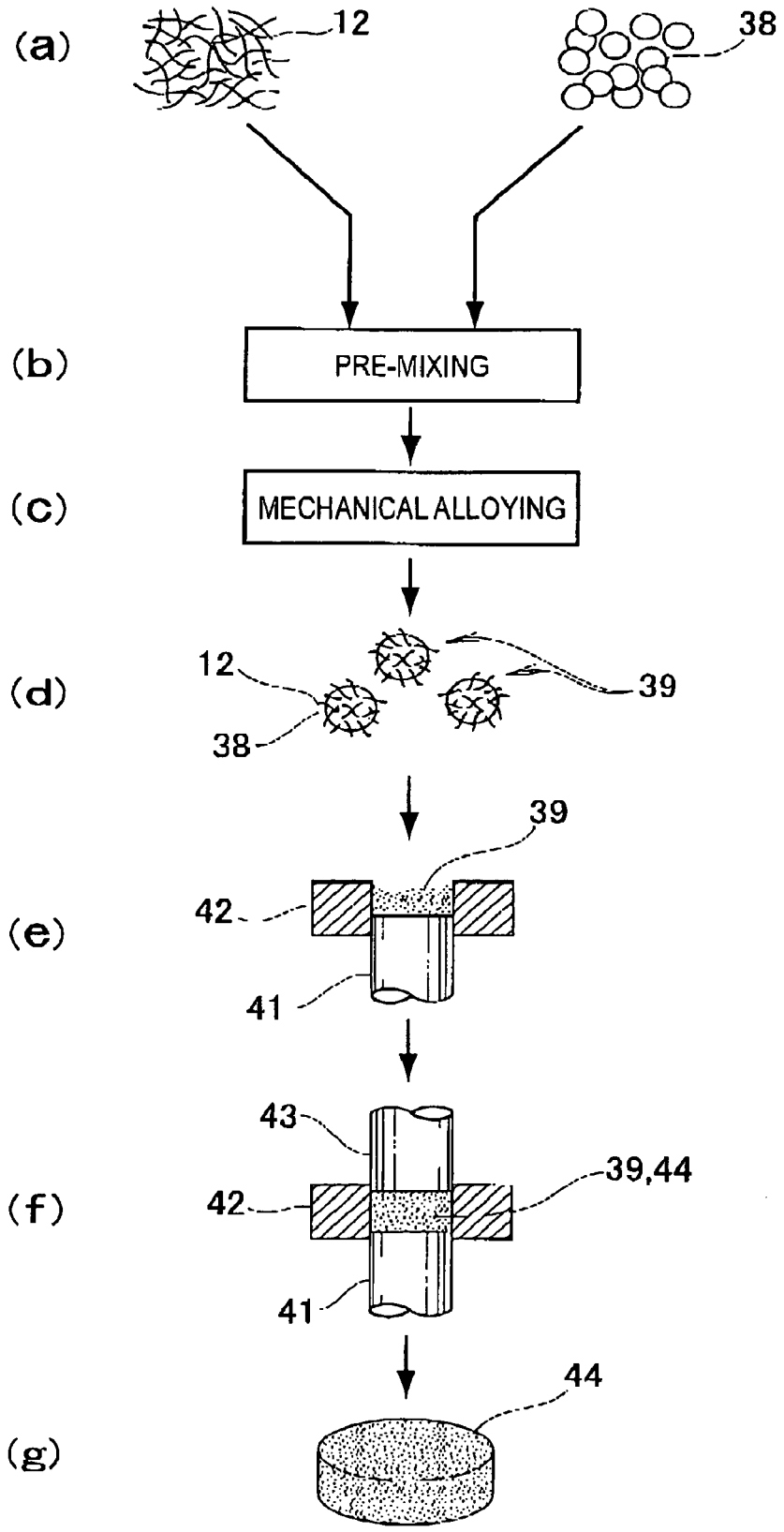
Figure 8:
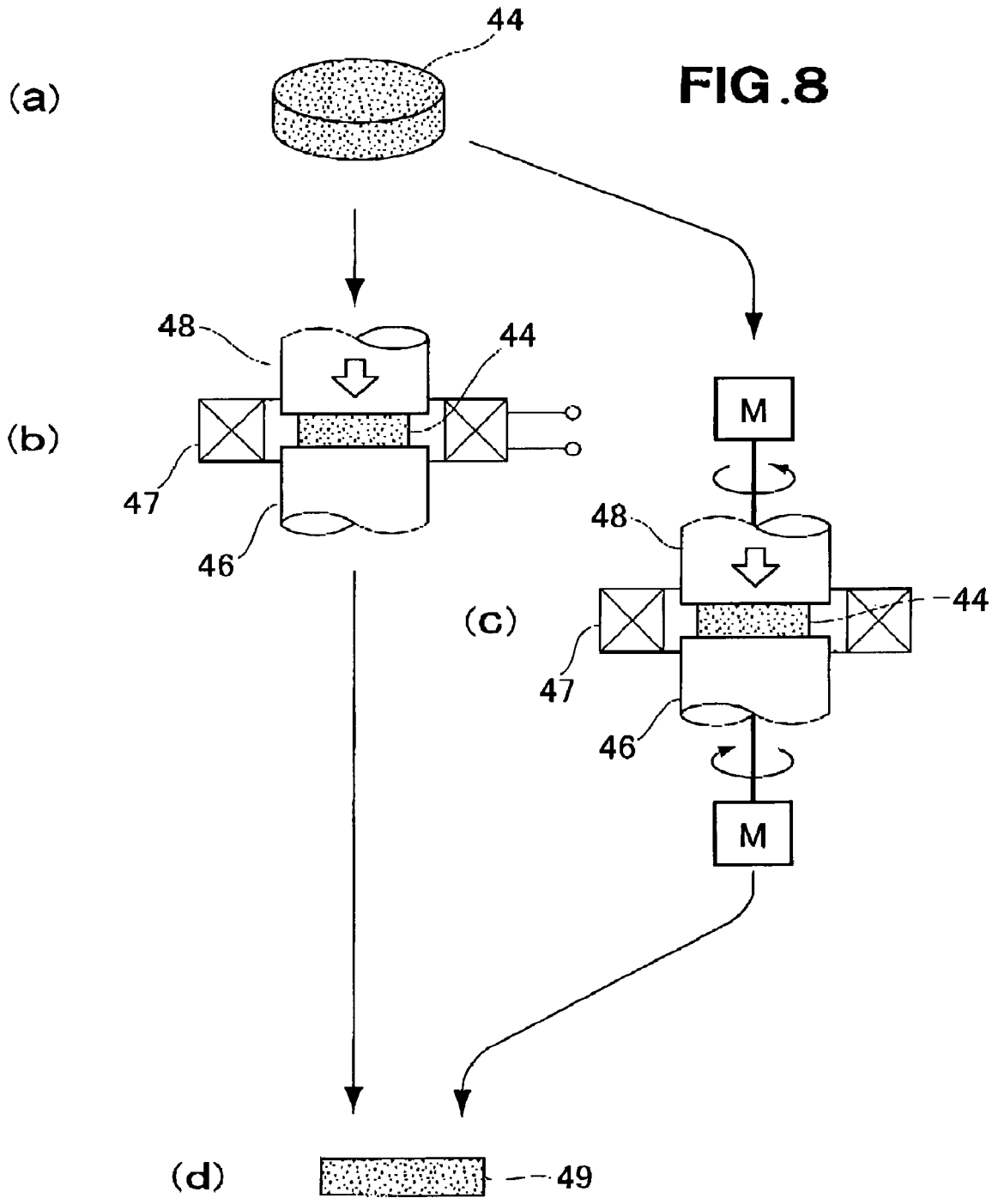
Figure 9:
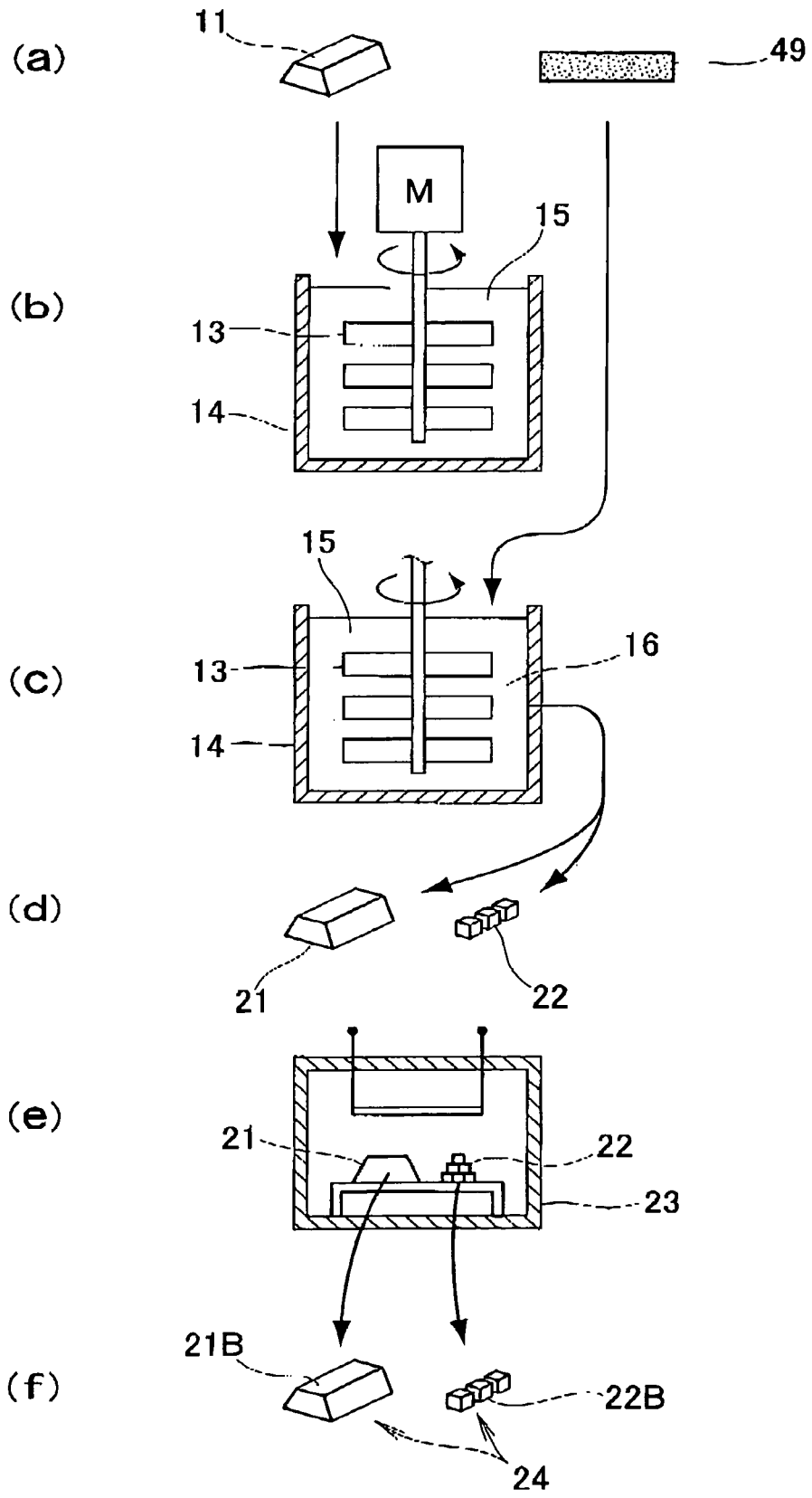
Figure 10:
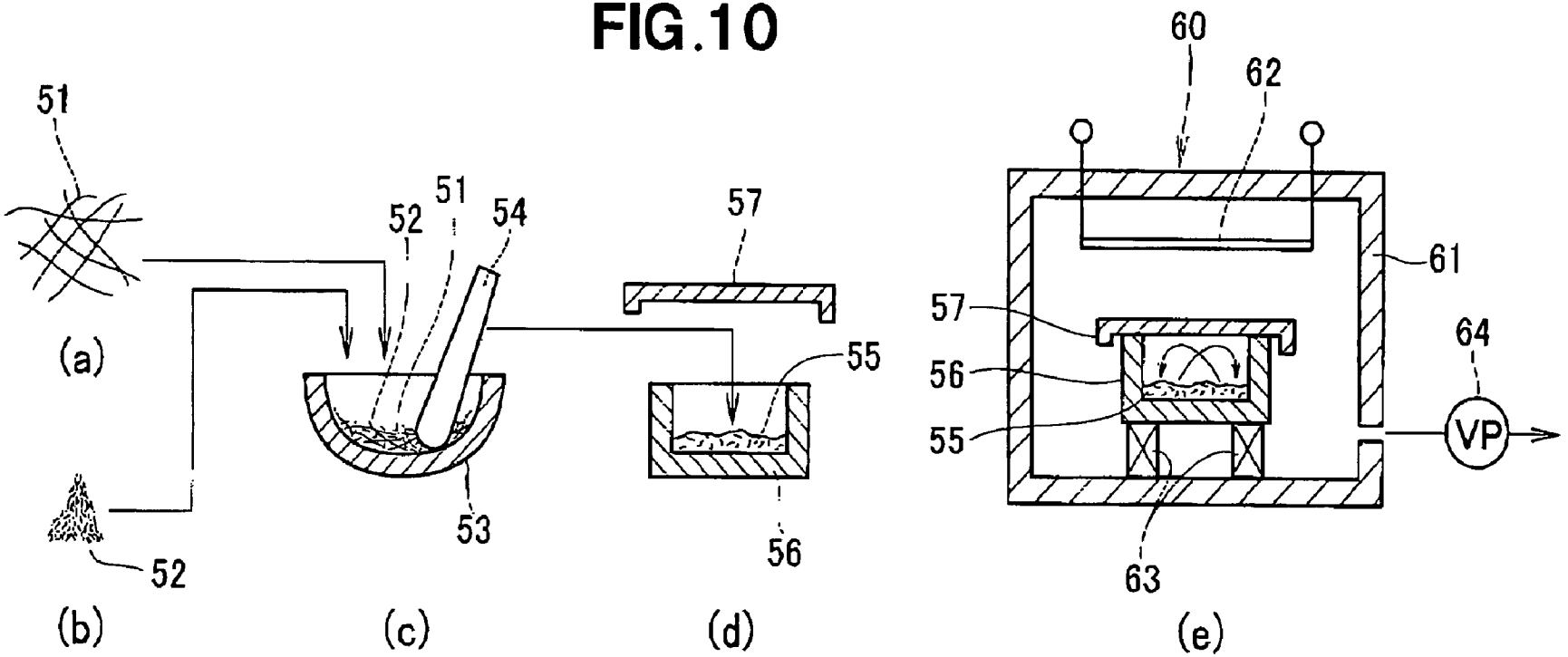
Figure 11A:
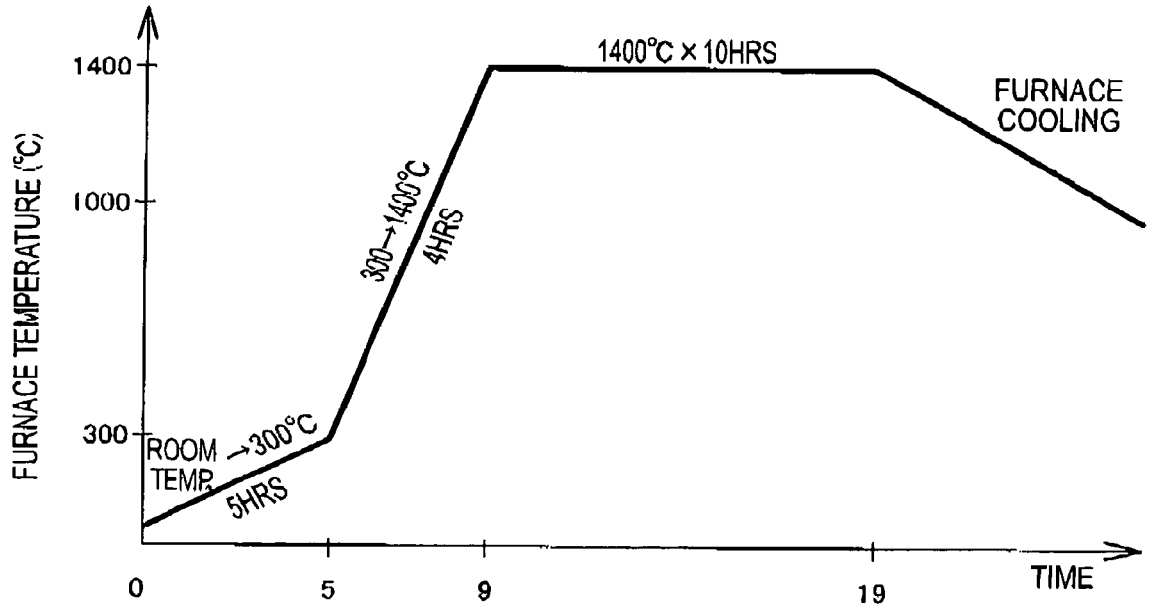
Figure 11B:
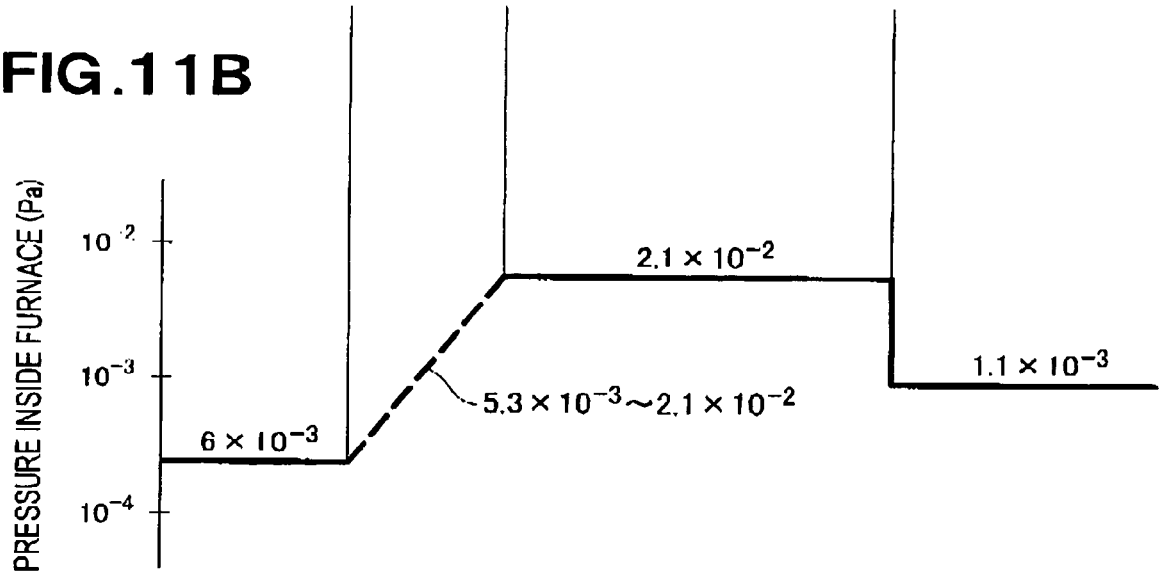
Figure 12:
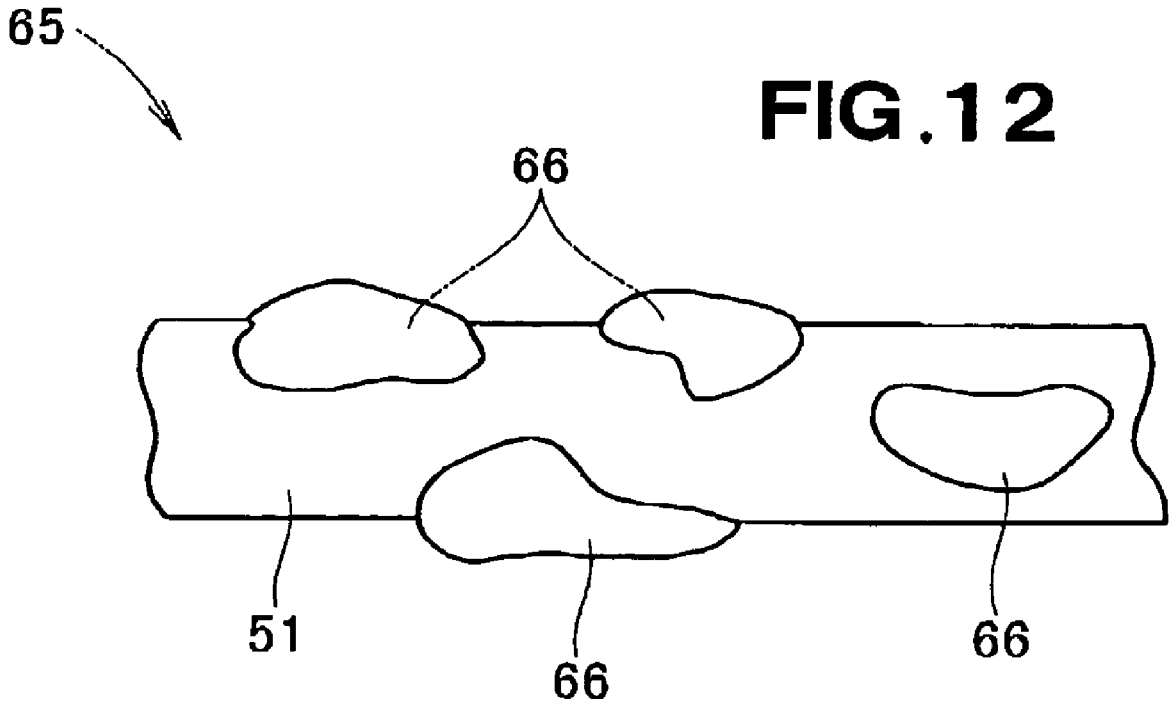

(*a*) through (*g*) of FIG. 7 show steps for obtaining a carbon nano-composite metal powder and a preform according to the present invention;

FIG. 8(*a*) through (*d*) show steps for obtaining a compression-formed product using the preform manufactured in FIG. 7;

FIG. 9(*a*) through (*f*) show another embodiment of the steps for manufacturing the composite-metal-forming material according to the present invention;

FIG. 10(*a*) through (*e*) show steps for surface-treating a carbon nanomaterial;

FIG. 11A and FIG. 11B are graphs showing a furnace temperature and a furnace pressure corresponding to silicon; and FIG. 12 is an enlarged diagram of a metal-deposited carbon nanomaterial manufactured by the steps of FIG. 10.

DETAILED DESCRIPTION OF THE PREFERRED EMBODIMENTS

First, an embodiment of a method for manufacturing a composite-metal-forming material according to the present invention will be described based on FIGS. 1 through 4.

Figure 1:
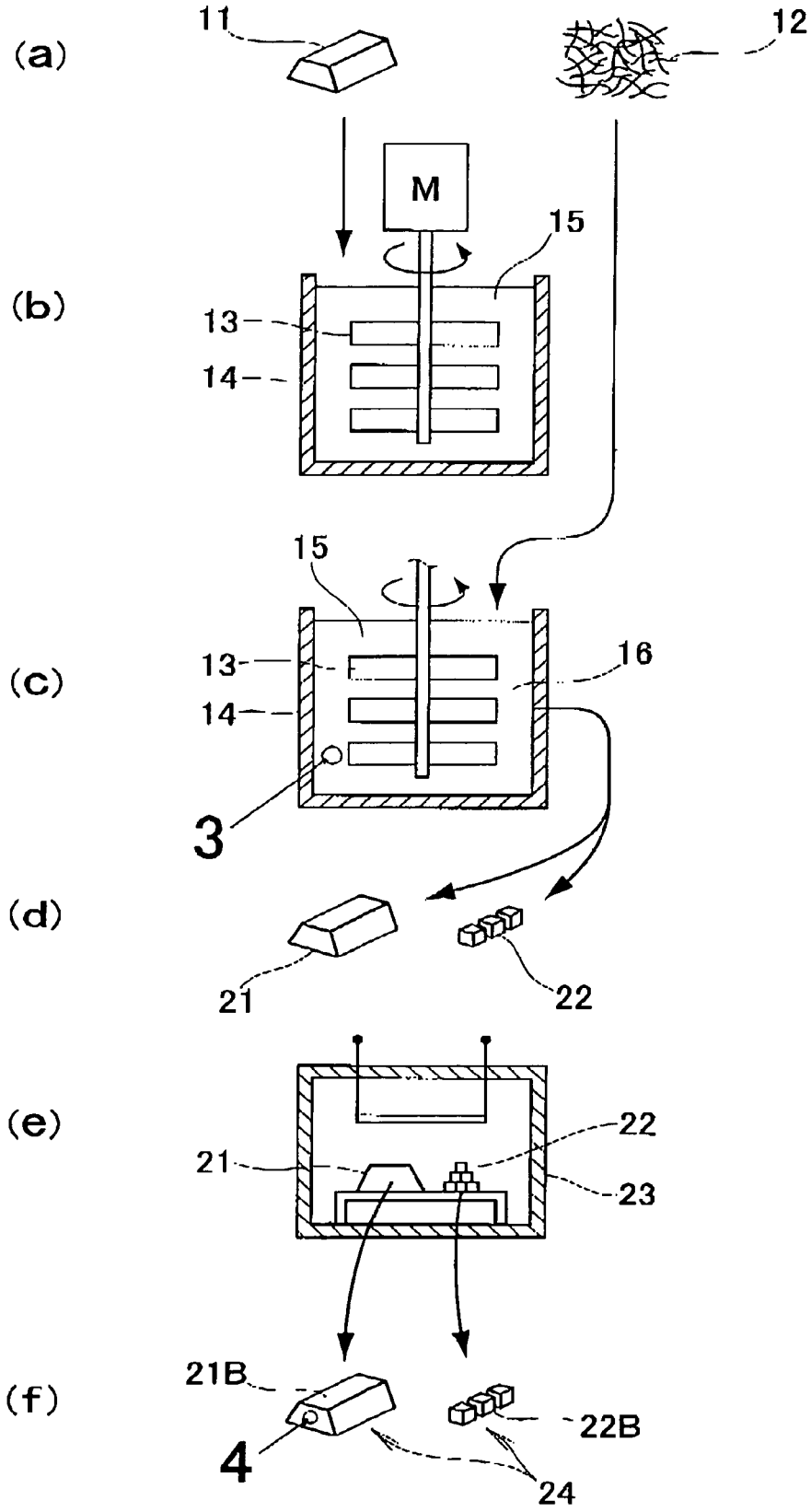

As shown in (*a*) of FIG. 1, an Mg alloy material 11 is prepared as a metallic material and a carbon nanomaterial 12 is prima red as an additive material.

The Mg alloy material 11 is, for example, ASTM AZ91D (equivalent to die-cast Mg alloy JIS H 5303 MDC1D). The composition of the material specified by AZ911) is approximately 9 mass % Al and the remaining portion comprises a small quantity of elements, inevitable impurities, and Mg.

Figure 2:
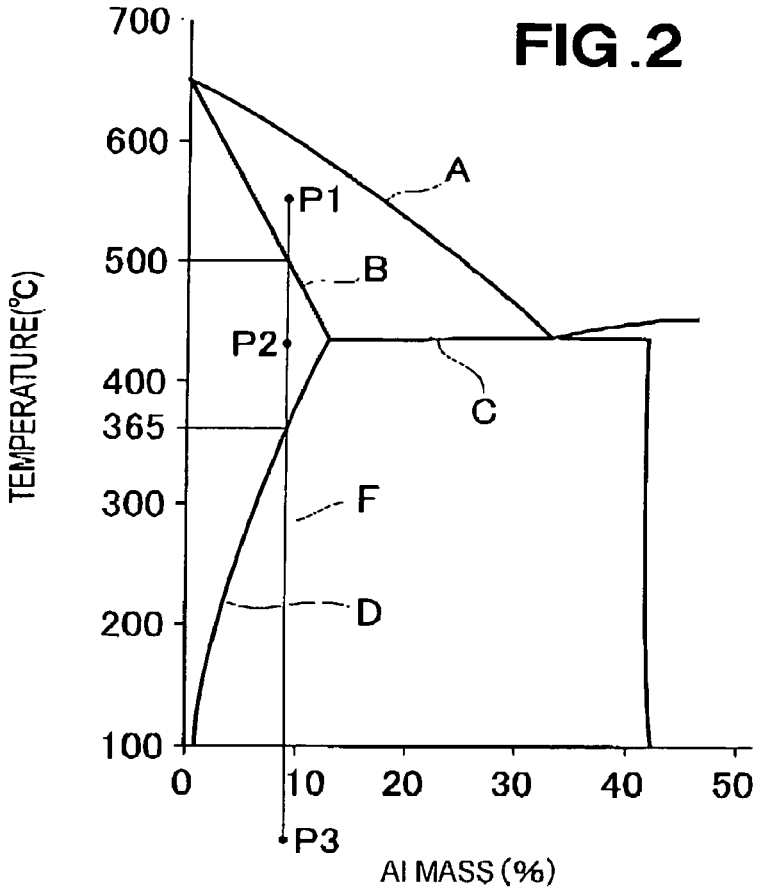
FIG. 2 is a graph showing an equilibrium state of an Mg—Al system.

FIG. 2 is a graph showing the equilibrium state of an Mg—Al system. A is the liquidus line, B is the solidus line, C is the eutectic line, and D is the solid solubility line. The area enclosed by A, B, and C is a region where solid and liquid states are both present, and the areas to the left of B and D are solution treatment regions.

F, which extends parallel to the longitudinal axis, is a temperature line corresponding to AZ91D; and P1, P2, and P3, which are indicated on the temperature line F are the semi-molten temperature, a solution treatment temperature, and a room temperature, respectively.

As shown in (*b*) of FIG. 1, the Mg alloy material 11 is charged into a dissolution tank 14 provided with a stirrer 13, heated until the semi-molten temperature P1 shown in FIG. 2, and stirred thoroughly. A semi-molten metal material 15 is thereby able to be obtained.

As shown in (*c*) of FIG. 1, a carbon nanomaterial 12 is subsequently introduced to and kneaded thoroughly with the semi-molten metal material 15. A composite metal material 16 in a semi-molten state can thereby be obtained. The composition image of the composite metal material 16 will be described with reference to FIG. 3.

Figure 3:
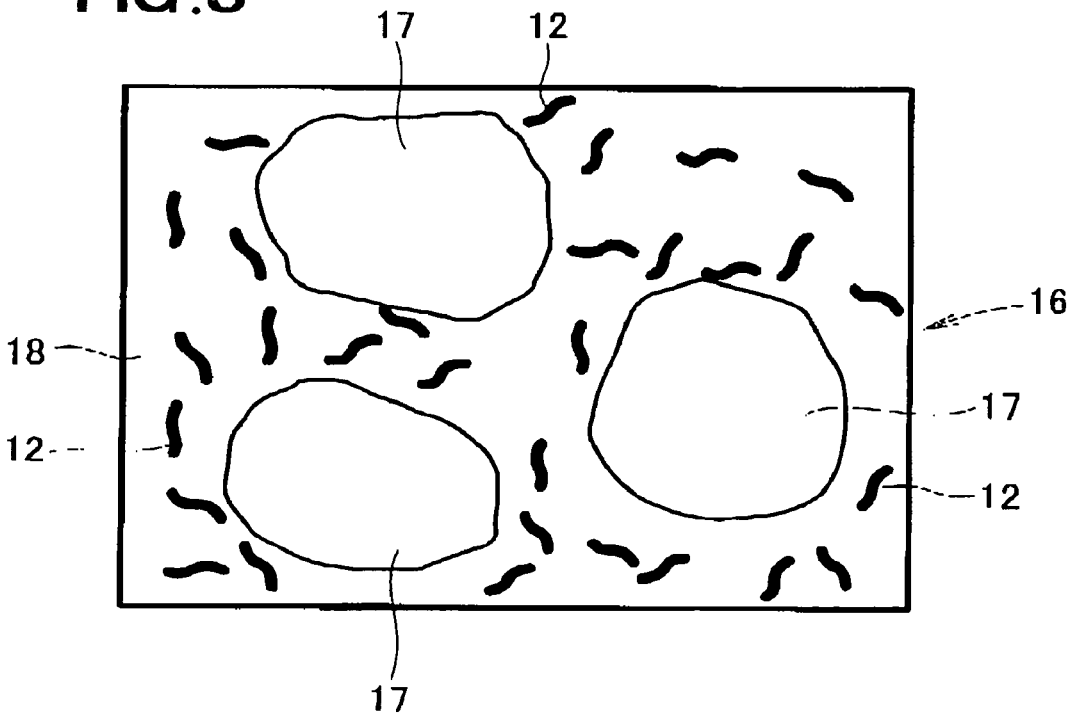
FIG. 3 is an enlarged, view of part 3 of FIG. 1(*c*) and shows an image of a composition of the composite-metal-forming material.

FIG. 3 shows an image of a composition of the composite metal material 16. A solid-phase portion 17 and a liquid-phase portion 18 are both present in the composite metal material 1G. An indeterminate quantity of the carbon nanomaterial 12 is mixed in the liquid-phase portion 18.

As shown in (*d*) of FIG. 1, removing and cooling the composite metal material 16 in a semi-molten state enables an ingot 21 or billets 22 of suitable size to be obtained. The billets 22 are casting pieces far smaller than the ingot 21.

As shown in (*e*) of FIG. 1, the ingot 21 or the billets 22 are subsequently placed in a solution treatment furnace 23 and then heated to the solution temperature P2 shown in FIG. 2. The temperature is maintained for 16 to 24 hours. Once this process bus concluded, the ingot 21 or billets 22 are rapidly cooled to around room temperature (P3 in FIG. 2). The solution treatment is thus completed.

The ingot 21B and billets 22B shown in (*f*) of FIG. 1 are materials that have already been solution-treated. Since the materials are preferably ones to be supplied to an injection forming machine (metal injection machine), they are called composite-metal-forming materials 24. The composition image of the composite-metal-forming material 24 will be described with reference to FIG. 4.

FIG. 4 is an image of the composition of the composite-metal-forming material. The composite-metal-forming material 24 has a uniform solid solution structure overall. Reference symbol 25 is a line showing a grain boundary.

A chipping step and an injection step that are desirably performed following the steps shown in FIG. 1 will be described based on FIG. 5.

FIG. 5(*a*) shows the ingot 21B and billets 22B shown in (*f*) of FIG. 1.

It is desirable to break the ingot 21B into chips 27 by administering a crushing treatment as shown in (*b*) of FIG. 5. The chips 27 are crushed to a size of a few millimeters.

As shown in (*c*) of FIG. 5, the chips 27 or billets 22B, which are at room temperature, are supplied to a metal injection machine 28. The chips 27 or billets 22B are heated to the semi-molten temperature (P1 in FIG. 2) in the metal injection machine 28. The composition image of the material at this time will be described with reference to FIG. 6.

Figure 6:
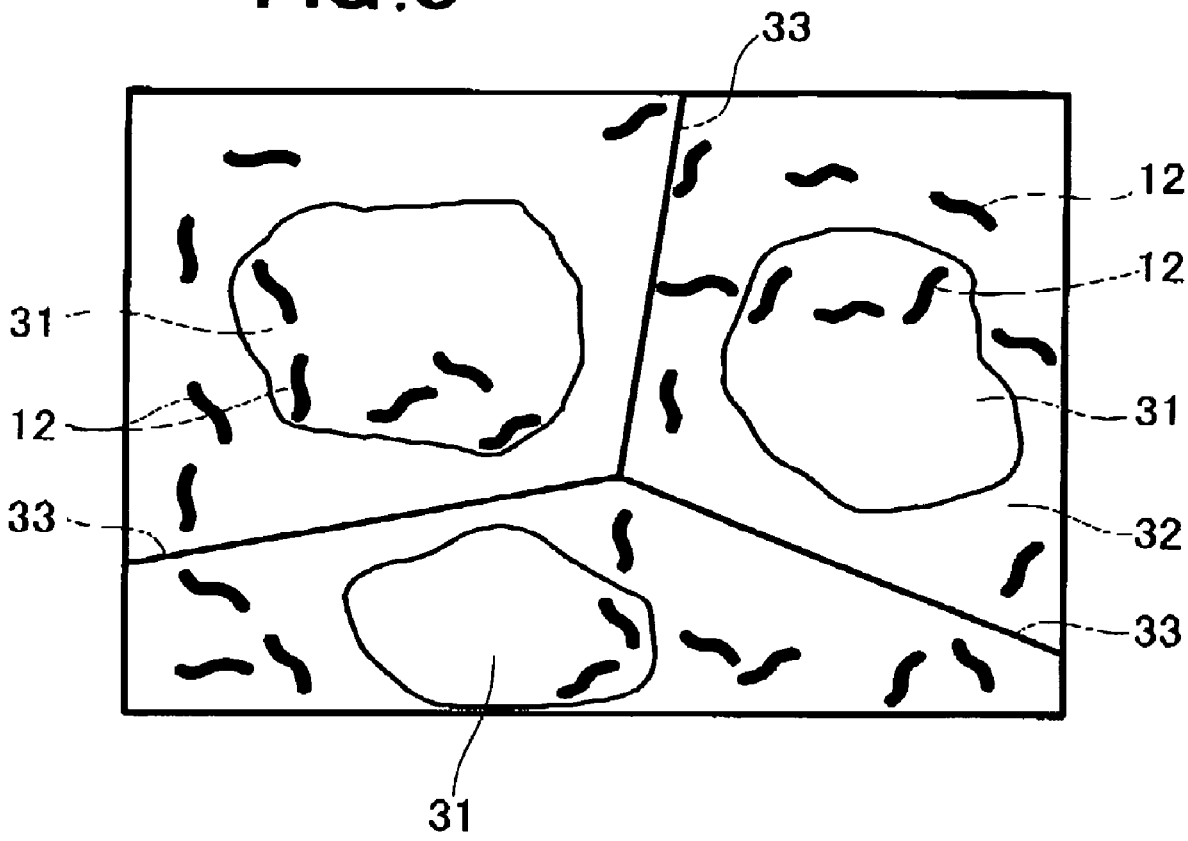
FIG. 6 is an enlarged view of part 6 of FIG. 5(*c*) and shows the image of a composition of the composite-metal-forming material.

FIG. 6 shows the image of a composition of the composite-metal-forming material. A new solid-phase portion 31, a new liquid-phase portion 32, and a new grain boundary 33 appear. The carbon nanomaterial 12 is included in the new solid-phase portion 31. The amount of the carbon nanomaterial 12 included in the new liquid-phase portion 32 of FIG. 6 is less than in FIG. 3. As a result, the fluidity of the new liquid-phase portion 32 is higher.

The following are believed to be the reasons behind the formation of a new structure comprising the new solid-phase portion 31, the new liquid-phase portion 32, and the new grain boundary 33 shown in FIG. 6.

(1) The composite metal material formed into a uniform solid solution by the solution treatment is crushed. The crushing work-hardens the chips, and internal strain occurs in the crystal grains within the structure.

(2) The crushed composite metal material is heated to the semi-molten temperature. Recrystallization occurs when [the crushed composite metal material] reaches the recrystallization temperature (e.g., around 150° C. for Mg). Recrystallization yields stable, crystal grains free from internal strain; however, the crystals deformed by the working are divided into polygonal fine grains. When the divided crystal is produced, a new structure comprising the new liquid-phase portion, the new solid-phase portion, and the new grain boundary is formed.

(3) The above yields a composite metal material having a new structure wherein the carbon nanomaterial 12 is entrained in the new solid-phase portion 31.

Reasons why crushing of the chips causes a new structure to form, are given above; however, even when a composite metal material that has not been crushed is used, using cold working to cause work hardening and heating the material to the recrystallization temperature or above will likely produce the same actions and effects.

In FIG. 5(*c*) the material in a semi-molten state is injected into a cavity 35 of a die 34. Since the fluidity of the material is high, the material flows to all areas of the cavity 35.

The die 34 is opened to yield a composite metal-formed article 36, 36, which is shown in (*d*) of FIG. 5; however, the composite-metal-formed article 36, 36 is a high-quality injection-formed product wherein the carbon nanomaterial 12 is uniformly distributed.

The outer surfaces of the chips 27 shown in (*b*) of FIG. 5 are the fracture surface, and the semi-molten begins from the fracture surface. Specifically, the solid solution structure melts from the outer shell. As a result, the composition shown in FIG. 6 is more reliably obtained. Therefore, the chips 27 axe capable of yielding an injection-formed product of higher quality than the billets 22B.

A method for obtaining a solution-treated composite-metal-forming material 24 using steps that are different from those in the example shown in FIG. 1 will now be described based on FIGS. 7 through 9.

(*a*) through (*f*) of FIG. 7 show steps for obtaining a carbon nano-composite metal powder and steps for obtaining a preform.

FIG. 7(*a*): A carbon nanomaterial 12 that has a fiber diameter (average value) of 10 nm to 200 nm is prepared, and a metal powder 38 that has a grain diameter (average value) of 4 mm or less is prepared. The metal powder 38 is preferably Mg, an Mg alloy, Al, or an Al alloy.

FIG. 7(*b*): Premixing is performed. Premixing may be performed by introducing a suitable amount of the carbon nanomaterial 12 and the metal powder 38 into a container and shaking the container.

FIG. 7(*c*): The carbon nanomaterial 12 and the metal powder 38 are thoroughly kneaded using mechanical alloying. Mechanical, alloying is a mechanical mixing method in a broad sense, and refers to a "solid-state alloying method using a high-energy attritor or a ball mill" as stipulated in JIS Z2500, or a "method for using a high-energy mill to mechanically stir, mix, and pulverize a variety of types of starting powders; and use a solid-state reaction to achieve an alloyed state," which is a mechanical alloying method as stipulated by JIS H7004. These methods are universally known; therefore, a description of the apparatus and principles has been omitted.

FIG. 7(*d*): The preceding processes cause the carbon nanomaterial 11 to deaggregate, and yield a carbon nano-composite metal powder 39 in a form in which the metal powder 38 is covered with innumerable particles of the carbon nanomaterial 12. Specifically, (*a*) through (*c*) of FIG. 7 mentioned above correspond to steps for obtaining the carbon-nano composite metal powder.

FIG. 7(*e*): A die 42 is positioned on a bottom punch 41, and the die 42 is filled with the carbon nano-composite metal powder 39.

FIG. 7(*f*): A top punch 43 is inserted in the die 42, and the carbon nano-composite metal powder 39 is compacted, into a solid while a temperature of about 150° C. is maintained. A preform 44, which is shown in FIG. 7(*g*), is thereby obtained.

Powder compaction can be complicated by the properties of the powder. In this event, the powder is introduced into a metal container and pressurized.

FIG. 8 shows steps for obtaining a compression-formed product from a preform 44.

(*a*) of FIG. 8 shows the preform 44 manufactured in the previous step shown in FIG. 7.

FIG. 8(*b*): The preform 44 is placed on a bottom punch 46 of a device whereby the atmosphere, temperature, and pressure are freely controlled; with the preform 44 being surrounded by a heater 47. A non-oxidizing atmosphere such as a vacuum or argon gas is maintained; the semi-molten temperature of the metal powder 38 (FIG. 7(*a*)) is maintained; and the preform 44 is compressed by a top punch 48.

As long as the metal powder is, e.g., an ASTM AZ91D (equivalent to die-cast Mg alloy JISH 5303 MDC1D), the semi-molten temperature is set to 585° C., and the pressure of the top punch 48 is set to 100 to 200 MPa.

The method for compression shown in FIG. 8(*c*) may be performed instead of the one shown in FIG. 8(*b*).

FIG. 8(*c*): The preform 44 is placed on a bottom punch 46 of a device whereby the atmosphere, temperature, pressure, and rotation are freely controlled; with the preform 44 being surrounded by a heater 47. A vacuum, argon gas, or other non-oxidizing atmosphere is maintained; the semi-molten temperature of the metal powder 38 (FIG. 7(*a*)) is maintained; and the preform 44 is compressed by a top punch 48.

During compression, the bottom punch 46 and the top punch 48 are rotated in opposite directions with respect to each other at a low speed; i.e., about five rotations per minute. A shear force is applied at the same time that the preform is subjected to pressure, whereby an oxide film that surrounds the powder surface can be effectively destroyed. As long as the oxide film is able to be destroyed, the powder grains become closely attached, and the mechanical strength of the compression-formed preform can be increased.

In (*b*) and (*c*) of FIG. 8, steps are performed wherein the preform 44 obtained by compacting the carbon nano-composite metal powder is pressurized in a state of being heated to the semi-molten temperature and then cooled, resulting in a compression-formed product. However, the carbon nanomaterial is accordingly further dispersed since deaggregation occurs in the mixing step, and the covering carbon nanomaterial undergoes compression-deformation hi a state where a solid and liquid are both present.

FIG. 8(*a*) through (*c*) as described above corresponds to steps for obtaining a compression-formed product.

FIG. 8(*d*): A compression-formed product 49 in which the carbon nanomaterial has been adequately dispersed is obtained.

(*a*) through (*f*) of FIG. 9 show another embodiment of steps for manufacturing the composite metal-forming material shown in FIG. 1.

As shown in FIG. 9(*a*), the Mg alloy material 11 is prepared as a metallic material and the compression-formed product 49 is prepared as an additive material.

As shown in FIG. 9(*b*), the Mg alloy material 11 is charged into a dissolution tunic 14 provided with a stirrer 13, heated up to semi-molten temperature P1 (FIG. 2), and thoroughly stirred. A semi-molten metal material 15 is thereby obtained.

Next, as shown in FIG. 9(*c*), the compression-formed product 49 is subsequently charged into the semi-molten metal material 15 and thoroughly kneaded. A composite metal material 16 in a semi-molten state is thereby obtained.

As shown in FIG. 9(*d*), cooling the composite metal material 16 in a semi-molten state yields an ingot 21 or billets 22 of suitable size.

As shown in FIG. 9(*e*), the ingot 21 or billets 22 are introduced into a solution treatment furnace 23, heated to the solution temperature P2 shown in FIG. 2, and are held at that temperature for 16 to 24 hours. The ingot 21 or billets 22 are then rapidly cooled. The solution treatment is thus completed.

The ingot 21B and billets 22B shown in FIG. 9(*f*) are solution-treated materials. These materials are preferred as materials to be supplied to an injection forming machine, and are accordingly called composite-metal-forming materials 24. A chipping step and injection step may subsequently be performed as shown in FIG. 5.

The carbon nanomaterial 12 prepared as shown in FIG. 1(*a*) and the carbon nanomaterial 12 prepared as shown in FIG. 7(*a*) have poor wettability with respect to metals, and are therefore preferably pretreated.

(*a*) through (*e*) of FIG. 10 show a surface treatment of the carbon nanomaterial performed in order to improve the wettability with respect to the metal.

FIG. 10(*a*): A carbon nanomaterial 51 is prepared; e.g., in an amount of 10 g. The carbon nanomaterial 51 can be the same as the carbon nanomaterial 12 shown in FIG. 1(*a*) or FIG. 7(*a*); however, as a matter of convenience, the symbols have been changed.

FIG. 10(*b*): a silicon powder 52 is prepared for use as a carbide-forming element; e.g., in an amount: of 10 g.

FIG. 10(*c*): The carbon nanomaterial 51 and silicon powder 52 are introduced into a mortar 53, and mixed using a pestle 54 for 15 to 30 min.

FIG. 10(*d*): The resulting mixture 55 is introduced into an alumina container 56, which is covered with an alumina lid 57. A non-sealing lid is used for the lid 57, thereby enabling air to pass in and out of the container 56.

FIG. 10(*c*): a vacuum furnace 60 is prepared, the furnace being provided with a sealed furnace body 61, heating means 62 for heating the interior of the furnace body 61, a stand 63 on which the container 56 is placed, and a vacuum pump 64 for forming a vacuum inside the furnace body 61. The container 56 is placed in the vacuum furnace 60.

The heating and pressurizing conditions used in the vacuum furnace 60 are described with reference to FIG. 11A and FIG. 11B. Heating the mixture 55 in a vacuum causes the silicon powder therein to evaporate. The resulting vapor bubbles through the space defined by the container 56 and the lid 57. This action is known as bubble stirring. The carbon nanomaterial is loosened by the bubble stirring; and the Si vapor comes into contact with the surface of the loosened carbon nanomaterial, forms a compound, and adheres in the form of Si microparticles.

FIG. 10 in essence shows that the surface treatment of the carbon nanomaterial comprises a step wherein the metal powder 52, which includes an element that reacts with carbon and forms a compound, is admixed with the carbon nanomaterial 51; and a vapor deposition treatment step wherein the resulting mixture 55 is placed in the vacuum furnace 60, the metal powder 52 is caused to evaporate at high temperature in a vacuum, and the vapor is caused to adhere to the surface of the carbon nanomaterial 51.

FIG. 11A and FIG. 11B are graphs showing the furnace temperature and inner pressure in relation to the Si, with the horizontal axis showing the time, and the vertical axes showing the furnace temperature and inner pressure.

At a degree of vacuum of $6\times10^{3}$ Pa, the furnace temperature is raised from room temperature to 300° C. over five hours.

At a degree of vacuum of $5.3\times10^{-3}$ to $2.1\times10^{-2}$ Pa, the furnace temperature is then raised from 300° C. to 1400° C. over four hours.

Conditions are maintained for ten hours at 1400° C. and a degree of vacuum of $2.1\times10^{-2}$ Pa.

The melting point of Si is 1427° C.; therefore, a temperature just below the melting point (1350° C. to 1400° C.) is maintained, and the Si is held in a state of saturated vapor pressure at this temperature. At 1350° C. the saturated vapor pressure is about $1.3\times10^{-3}$ Pa, and at 1400° C. the saturated vapor pressure is about $2.1\times10^{-2}$ Pa. These approximate degrees of vacuum can be readily attained using a vacuum furnace, and therefore a processing temperature of 1350° C. to 1400° C. is suitable. However, the evaporation rate at 1350° C. is low, and the processing temperature in the present embodiment is 1400° C. so that the evaporation rate will be higher.

SiC (silicon carbide), which is a compound of Si and carbon, will be described below. The standard free energy of formation of SiC is −39.6 kJ/mol at 1400° C., and since this condition can be met, Si vapor is thought to react with the carbon in the carbon nanomaterial and form SiC.

Therefore, should the mixture be introduced into a semi-sealed container, and the Si powder caused to evaporate, bubble stirring will occur, and Si microparticles can be caused to adhere to the carbon nanomaterial.

The conditions are maintained for long period of time; i.e., 10 hours, in order for stirring and reacting to be adequately performed. It shall be apparent that the lime over which the conditions are maintained may be increased or decreased according to the mixture ratio, the throughput, and other conditions.

Heating is terminated after 19 hours; however, furnace cooling is performed while a degree of vacuum of $1.1\times10^{-3}$ Pa is maintained. Furnace cooling is a method for cooling the manufactured articles in an extremely gradual manner.

FIG. 12 shows a metal-deposited carbon nanomaterial manufactured by the method shown in FIG. 10.

A metal-deposited carbon nanomaterial 65 comprises a deaggregated carbon nanomaterial 51, and multiple Si microparticles 66 uniformly adhering to the surface of the carbon nanomaterial 51. As previously stated, the Si microparticles 66 are obtained by crystallizing Si, which is an element that reacts with carbon and forms a compound.

It is important that the Si microparticles 66 adhere to the carbon nanomaterial 51 with SiC as the carbide interposed therebetween. Since the carbon nanomaterial 51 has poor wettability, a concern is presented that the contact strength would be inadequate if the Si microparticles were used alone. In this regard, causing Si microparticles to adhere to the surface of the carbon nanomaterial 51 enables a SiC reaction layer to form at the interface, and the Si microparticles 66 can be caused to securely adhere to the carbon nanomaterial 51.

Replacing the carbon nanomaterial 12 shown in FIG. 1(*a*) or FIG. 7(*a*) with the metal-deposited carbon nanomaterial 65 enables the adhesion between the metal material and the carbon nanomaterial to be increased, and a formed product having exceptional mechanical strength to be obtained.

The metal material may be an Al alloy as well as an Mg alloy. If an Al alloy is used, an Al—Si system alloy is preferred.

Even if the Si used as a carbide-forming metal (an element that reacts with metallic carbon and generates a compound) is substituted for Ti, the same effect in terms of an improvement in mechanical strength can be obtained, although a detailed description thereof is omitted. Furthermore, in addition to Si and Ti, Zr (zirconium) and V (vanadium) can be employed for use in forming carbide. However, Si and Ti are both readily available, and Si in particular is inexpensive; therefore, both enable the method of the present invention to be used more widely, and are preferred.

Other than Mg or an alloy thereof having a melting point of about 650° C., the metal powder (matrix metal material) may be Al or an alloy thereof having a melting point of about 660° C., Sn or an alloy thereof having a melting point of about 232° C., and Pb or an alloy thereof having a melting point of about 327° C. Any type of metal powder may be used as long as it is a low-melting metal or alloy having a melting point that does not exceed 700° C.

In particular, Mg, Al and alloys of both are light metals. Adding the carbon nanomaterial to these metals and increasing the mechanical strength makes it possible to provide a lightweight yet strong structural material having exceptional heat transmission properties and abrasion resistance.

The present invention is preferred for a method for manufacturing a composite-metal-formed article obtained by combining a carbon nanomaterial with a metal material.

Obviously, various minor changes and modifications of the present invention are possible in light of the above teaching. It is therefore to be understood that within the scope of the appended claims the invention may be practiced otherwise than as specifically described.

What is claimed is:

1. A method for manufacturing a composite-metal-forming material, comprising the steps of:

preparing a metal material having a Mg alloy or an Al alloy;

preparing, as an additive material, a carbon nano-composite material formed by mixing a carbon nanomaterial and a metal powder to obtain a carbon nano-composite metal powder, compacting the carbon nano-composite metal powder into a solid to obtain a preform, heating the preform in a vacuum, inert gas, or non-oxidizing gas atmosphere to a temperature in a region where a solid and a liquid are both present, and applying pressure to the heated preform;

heating the metal material to a temperature in a region where a solid and a liquid are both present to thereby yield a semi-molten metal material in a semi-molten state;

introducing the additive material to the semi-molten metal material and performing kneading to obtain a composite metal material; and heating the composite metal material to a solution temperature of the metal material and performing a solution treatment to thereby yield a composite-metal-forming material.

2. A manufacturing method according to claim 1; wherein in the step of preparing the additive material, a shearing force is applied to the heated preform at the same time that the pressure is applied to the heated preform.

3. A manufacturing method according to claim 1; wherein the metal powder comprises a material selected from the group consisting of Mg, a Mg alloy, Al, or an Al alloy.

4. A manufacturing method according to claim 1; further comprising the step of crushing the composite-metal-forming material into chips.

5. A method for manufacturing a composite-metal-forming material, comprising the steps of:

preparing a metal material having a Mg alloy or an Al alloy;

preparing, as an additive material, a metal-deposited carbon nanomaterial formed by causing a carbide-forming element that contains an element that reacts with carbon and that forms a compound, to adhere to a surface of a carbon nanomaterial;

heating the metal material to a temperature in a region where a solid and a liquid are both present to thereby yield a semi-molten metal material in a semi-molten state;

introducing the additive material to the semi-molten metal material and performing kneading to obtain a composite metal material; and heating the composite metal material to a solution temperature of the metal material and performing a solution treatment to thereby yield a composite-metal-forming material.

6. A manufacturing method according to claim 5; wherein the step of preparing the additive material comprises mixing the carbon nanomaterial with the carbide-forming element, placing the resulting mixture in a vacuum furnace, and causing the carbide-forming element to evaporate in a vacuum under high temperature to thereby obtain the metal-deposited carbon nanomaterial.

7. A manufacturing method according to claim 6; wherein the carbide-forming element comprises a carbide-forming metal.

8. A manufacturing method according to claim 5; wherein the carbide-forming element is Ti or Si.

9. A manufacturing method according to claim 5; wherein the carbide-forming element comprises a carbide-forming metal.

10. A method for manufacturing a composite-metal-made article, comprising the steps of:

preparing a metal material having a Mg alloy or an Al alloy;

preparing, as an additive material, a carbon nano-composite material formed by mixing a carbon nanomaterial and a metal powder to obtain a carbon nano-composite metal powder, compacting the carbon nano-composite metal powder into a solid to obtain a preform, heating the preform in a vacuum, inert gas, or non-oxidizing gas atmosphere to a temperature in a region where a solid and a liquid are both present, and applying pressure to the heated preform;

heating the metal material to a temperature in a region where a solid and a liquid are both present to thereby yield a semi-molten metal material in a semi-molten state;

introducing the additive material to the semi-molten metal material and performing kneading to obtain a composite metal material;

heating the composite metal material to a solution temperature of the metal material and performing a solution treatment to thereby yield a composite-metal-forming material;

supplying the composite-metal-forming material into an injection forming machine and heating the composite-metal-forming material to a semi-molten state in the injection forming machine; and supplying the composite-metal-forming material in the semi-molten state into a cavity of a die to obtain a composite-metal-made article.

11. A manufacturing method according to claim 10; wherein in the step of preparing the additive material, a shearing force is applied to the heated preform at the same time that the pressure is applied to the heated preform.

12. A manufacturing method according to claim 10; wherein the metal powder comprises a material selected from the group consisting of Mg, an Mg alloy, Al and an Al alloy.

13. A manufacturing method according to claim 10; further comprising the step of crushing the composite-metal-forming materials into chips.

14. A method for manufacturing a composite-metal-made article, comprising the steps of:

preparing a metal material having a Mg alloy or an Al alloy;

preparing, as an additive material, a metal-deposited carbon nanomaterial formed by causing a carbide-forming element that contains an element that reacts with carbon and that forms a compound, to adhere to a surface of a carbon nanomaterial;

heating the metal material to a temperature in a region where a solid and a liquid are both present to thereby yield a semi-molten metal material in a semi-molten state;

introducing the additive material to the semi-molten metal material and performing kneading to obtain a composite metal material;

heating the composite metal material to a solution temperature of the metal material and performing a solution treatment to thereby yield a composite-metal-forming material;

supplying the composite-metal-forming material into an injection forming machine and heating the composite-metal-forming material to a semi-molten state in the injection forming machine; and supplying the composite-metal-forming material in the semi-molten state into a cavity of a die to obtain a composite-metal-made article.

15. A manufacturing method according to claim 14; wherein the step of preparing the additive material comprises mixing the carbon nanomaterial with the carbide-forming element, placing the resulting mixture in a vacuum furnace, and causing the carbide-forming element to evaporate in a vacuum under high temperature to thereby obtain the metal-deposited carbon nanomaterial.

16. A manufacturing method according to claim 15; wherein the carbide-forming element comprises a carbide-forming metal.

17. A manufacturing method according to claim 14; wherein the carbide-forming element is Ti or Si.

18. A manufacturing method according to claim 14; wherein the carbide-forming element comprises a carbide-forming metal.

* * * * *